US008020704B2

(12) United States Patent
Houle

(10) Patent No.: US 8,020,704 B2
(45) Date of Patent: Sep. 20, 2011

(54) STORING CASE

(76) Inventor: Denis Houle, St-Jérôme (CA)

( * ) Notice: Subject to any disclaimer, the term of this patent is extended or adjusted under 35 U.S.C. 154(b) by 25 days.

(21) Appl. No.: 12/431,222

(22) Filed: Apr. 28, 2009

(65) Prior Publication Data

US 2010/0108548 A1 May 6, 2010

Related U.S. Application Data

(60) Provisional application No. 61/049,074, filed on Apr. 30, 2008.

(51) Int. Cl.
*A45C 11/00* (2006.01)

(52) U.S. Cl. ..... 206/577; 206/314; 206/457

(58) Field of Classification Search ..... 206/314, 206/457, 577, 232, 223
See application file for complete search history.

(56) References Cited

U.S. PATENT DOCUMENTS 2,049,039 A * 7/1936 Ansley ..... 369/76
4,147,254 A * 4/1979 Bruce ..... 206/314
5,441,134 A * 8/1995 Carson ..... 190/111
5,590,771 A * 1/1997 Cota ..... 206/314
6,029,804 A * 2/2000 Flynn ..... 206/14
6,283,287 B1 * 9/2001 Carl ..... 206/314
6,723,909 B1 * 4/2004 Hooper, II ..... 84/453
7,176,366 B1 2/2007 Bruce
2009/0032480 A1 * 2/2009 Irish ..... 211/13.1

* cited by examiner

*Primary Examiner* — Jacob K Ackun, Jr.
(74) *Attorney, Agent, or Firm* — Bereskin & Parr LLP/ S.E.N.C.R.L., s.r.l.

(57) ABSTRACT

There is provided a storing case adapted to be disposed on top of an amplifier, an amplifier head, or an amplifier stack. The storing case is adapted to receive various accessories normally used by a musician and for storing them. The storing case has an external surface which is made of a material at least visually similar to the material of external surfaces of the amplifier, amplifier head, or amplifier stack. When the storing case is disposed on the amplifier, amplifier head, or amplifier stack, which is disposed on a stage, the storing case seems to be, for a spectator in front of the stage, an integral part of a set comprising the storing case and the amplifier, amplifier head, or amplifier stack.

11 Claims, 3 Drawing Sheets

STORING CASE

FIELD

The present document relates to the field of musical equipment/instrument. More specifically, it relates to a storing case adapted to be disposed on top of an amplifier speaker cabinet, an electronic musical instrumental, or vocal such as an amplifier (for example a power amplifier (PA)), an amplifier head, or an amplifier stack.

BACKGROUND

On a stage, musicians usually have to bring with them a lot of equipment in addition to their main instruments. The equipment or accessories can be, for example, effect pedals, power cords, strings, pics, slides, music sheets, cd's, cleaners, etc.

Musicians usually use some kind of tool chest bought at a local hardware store in order to store their equipment or accessories therein. The problem with such tool chests is that they are not to practical on the floor or a side somewhere when musicians need something. In such a situation a musician needs to put away the instrument, then pick up his/her tool chest or kneel down and take what he needs.

During live performances and various shows the visual aspect is very important for the spectators. A lot of efforts are made by the artists, concert producers and people responsible in the conception of a show to provide an interesting and original visual aspect to the show. In fact, the aesthetical aspect is very important. Thus, every element shown to the spectator is important. Therefore, most of the time it is not possible to use such tool chests or any other cabinet or storing case that would not fit with the general visual concept of the show.

Musicians usually consume various beverages during rehearsals and live performances. It is always dangerous for them to put such beverages on the amplifiers in view of the risks of spills. The same also applies when they put these beverages on the ground since they often perform under conditions at which the intensity of the light is quite low and sometimes in absence of light for a given period of time.

Musicians also do a lot of writing during rehearsals and are usually constantly trying to find a flat surface to write on.

It would thus be highly desirable to be provided with a solution that would fulfill at least one of the previously mentioned needs.

SUMMARY

According to one aspect, there is provided a storing case adapted to be disposed on top of an amplifier, an amplifier head, or an amplifier stack. The storing case is adapted to receive various accessories normally used by a musician (for example effect pedals, power cords, strings, pics, slides, music sheets, cd's, cleaners, and mixtures thereof) and for storing them. The storing case has an external surface which is made of a material at least visually similar to the material of external surfaces of the amplifier, amplifier head, or amplifier stack. When the storing case is disposed on the amplifier, amplifier head, or amplifier stack, which is disposed on a stage, the storing case seems to be, for a spectator in front of the stage, an integral part of a set comprising the storing case and the amplifier, amplifier head, or amplifier stack.

According to another aspect, there is provided a storing case adapted to be disposed on top of an amplifier, an amplifier head, or an amplifier stack. The storing case comprises:

a bottom portion adapted to be disposed on a top surface of the amplifier, amplifier head or amplifier stack;

walls connected to the bottom portion and defining an internal chamber adapted to receive accessories normally used by a musician;

optionally a top portion connected to at least one of the walls; and at least one of the walls or the top portion defining an aperture or being movable so as to permit access to the chamber by the musician, the walls comprising an external surface which is made of a material at least visually similar to the material of external surfaces of the amplifier, amplifier head, or amplifier stack, whereby when the storing case is disposed on the amplifier, amplifier head, or amplifier stack, which is disposed on a stage, the storing case seems to be, for a spectator in front of the stage, an integral part of a set comprising the storing case and the amplifier, amplifier head, or amplifier stack.

According to another aspect, there is provided a storing case adapted to be disposed on top of an amplifier, an amplifier head, or an amplifier stack. The storing case comprises:

a bottom portion adapted to be disposed on a top surface of the amplifier, amplifier head or amplifier stack;

walls connected to the bottom portion and defining an internal chamber adapted to receive accessories normally used by a musician;

optionally a top portion connected to at least one of the walls; and optionally at least one of the walls or the top portion defining an aperture or being movable so as to permit access to the chamber by the musician, the walls (or at least one of the walls) comprising an external surface which is made of a material at least visually similar to the material of external surfaces of the amplifier, amplifier head, or amplifier stack, whereby when the storing case is disposed on the amplifier, amplifier head, or amplifier stack, which is disposed on a stage, the storing case seems to be, for a spectator in front of the stage, an integral part of a set comprising the storing case and the amplifier, amplifier head, or amplifier stack.

For example, the top portion can be adapted receive another amplifier, amplifier head, or amplifier stack, and wherein one of the walls can be pivotably connected to the bottom portion or to at least another of the walls so as to move between a closed position and an open position at which the musician has access to the chamber. The wall pivotably connected to the bottom portion or to at least another of the walls can comprise an internal surface adapted to receive items (for example beverages, food) or musicians' accessories thereon when the wall is in the open position. The surface can comprise various securing means for securing the items or accessories to the surface. The wall can be pivotably connected to the bottom portion or to at least another of the walls in such a manner that when the wall is in the open position, the internal surface is substantially horizontally flush with a top surface of the bottom portion. The bottom surface of the bottom portion can be provided with a non-slid material such as a spacer. The top surface of the top portion can be provided with a handle.

For example, the walls can define a top aperture which is in communication with the chamber.

For example, the top surface can be pivotably connected to at least one of the walls and can be adapted to move between a closed position and an open position.

For example, at least one shelf and/or at least one drawer can be connected to at least one of the walls inside the chamber.

According to another aspect, there is provided a kit comprising an amplifier, a head amplifier, or an amplifier stack; and a storing case as previously defined.

BRIEF DESCRIPTION OF DRAWINGS

These and other features of the present document will become more apparent from the following examples in which reference is made to the appended drawings wherein.

DETAILED DESCRIPTION

Figure 1:
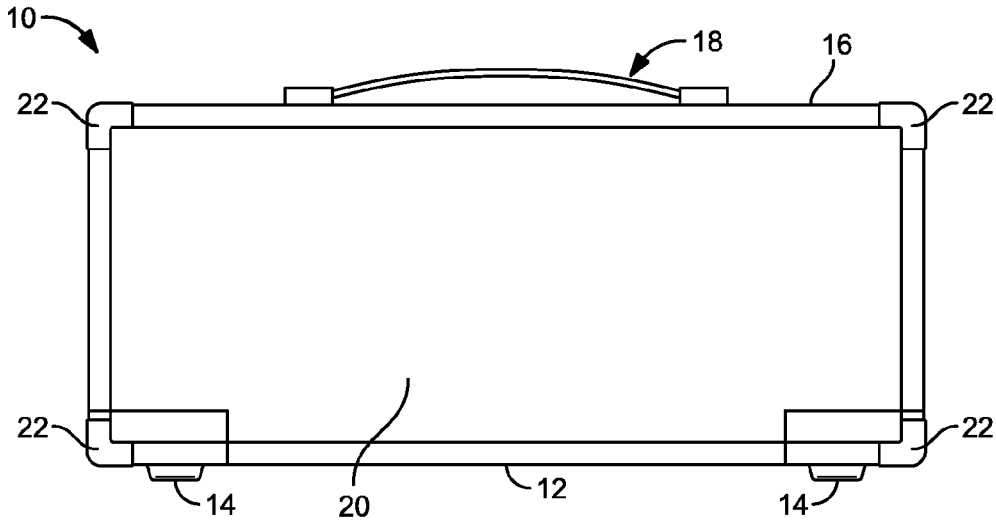
FIG. 1 is a front view of an example of a storing case as defined in the present document.
Figure 2:
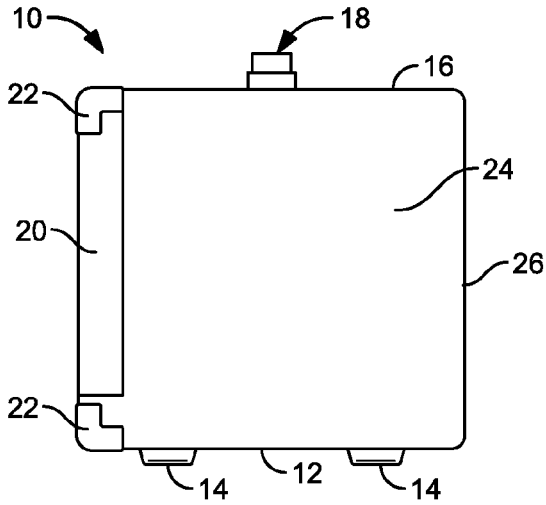
FIG. 2 is a side view of the storing case shown in FIG. 1, wherein a door or is shown in a closed position.
Figure 3:
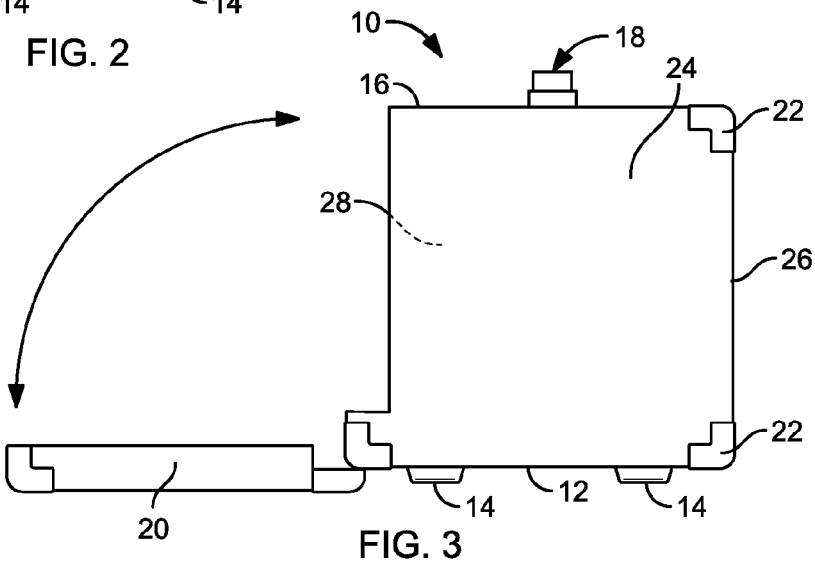
FIG. 3 is a side view of the storing case shown in FIG. 1, wherein the door is shown in an open position.
Figure 4A:
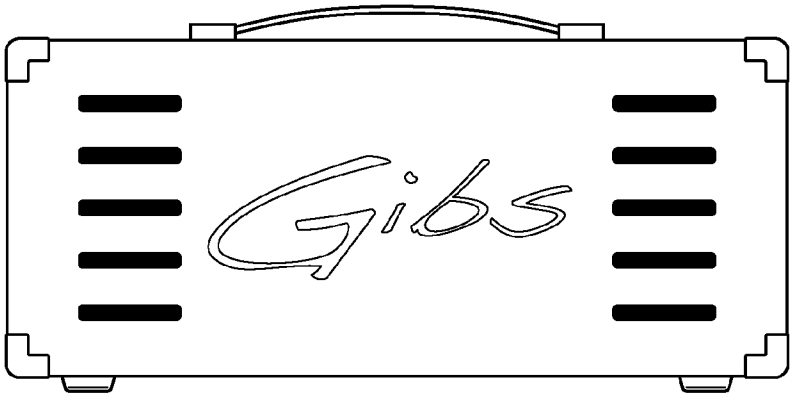
FIGS. 4*a*, 4*b*, 4*c* and 4*d*, are front views of various examples of storing cases as defined in the present document.
Figure 4B:
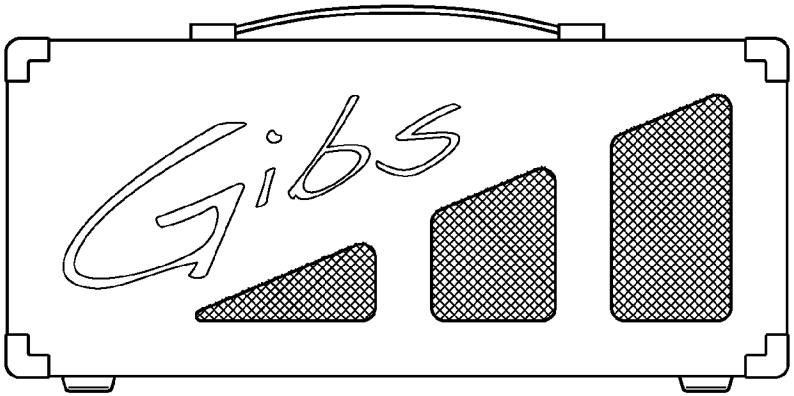
Figure 4C:
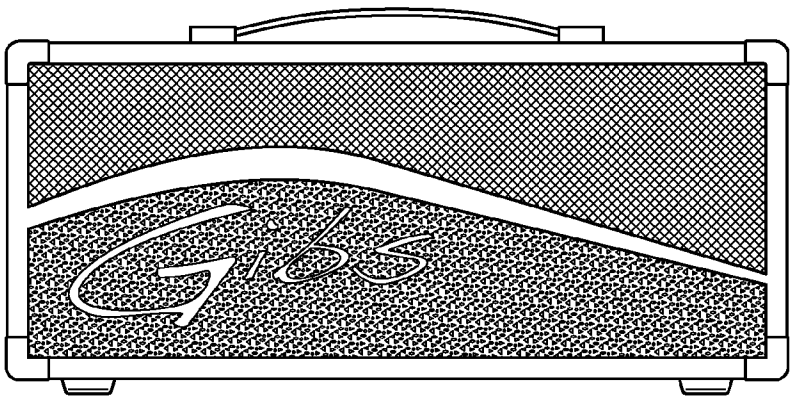
Figure 4D:
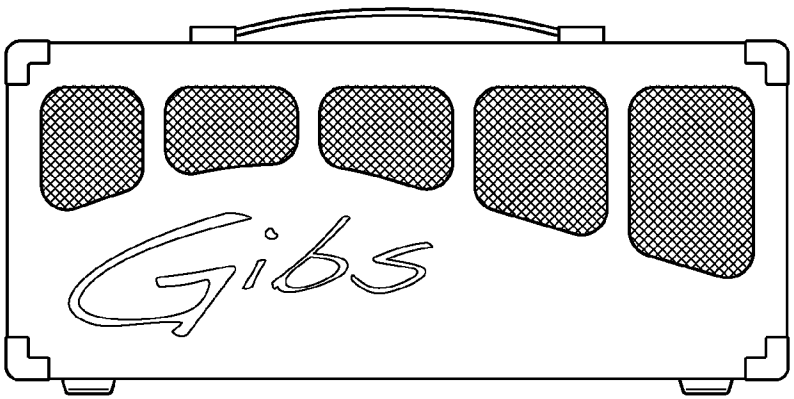

FIGS. 1, 2 and 3 shown the same storing case 10. FIG. 1 is a front view and FIGS. 2 and 3 shown the same side view. The storing case 10 comprises a bottom portion 12, spacers 14, a top portion 16, a handle 18, a door 20, protecting corners 22, side walls 24, rear wall 26, and an internal chamber 28.

FIGS. 4*a*, 4*b*, 4*c*, and 4*d* are storing cases similar to the case 10. They each have a different style i.e. a different visual aspect of the door.

As shown in FIGS. 1 to 3, the storing case 10 is adapted to be disposed on an amplifier, an amplifier head or an amplifier stack. It can be sandwiched between various units such as two amplifiers or an amplifier and an amplifier head etc. Because the visual aspect of the storing case 10 (or the storing cases shown in 4*a*, 4*b*, 4*c*, and 4*d*) is similar to an amplifier, an amplifier head or an amplifier stack, a spectator would believe that the storing case 10 is an integral part of a set comprising the storing case and the amplifier, amplifier head, or amplifier stack. On an aesthetical point of view, there is thus no mismatch with the general concept of a show since the storing case 10 fits with the existing amplifiers usually used by musicians.

The non-slid spacers 14 permit to secure the storing case when disposed on an amplifier or amplifier head. The handle 18 as shown in FIG. 1 can be moved downwardly so as to contact the top surface 16. Such a configuration is useful when another amplifier or amplifier head is disposed on the storing case 10.

The walls 24 and 26, the bottom portion 12 and the top portion 16 define an internal chamber 18 adapted to receive the equipment and accessories of a musician. The chamber 18 can be provided with at least one shelf or at least one drawer. The pivoting wall or door 20 can be pivoted from a closed position (FIG. 2) to an open position (FIG. 3). When the door 20 is in an open position, the musician can put some equipment, accessories, beverages, or any other object on the internal surface of the door. Such an internal surface can be, when the door 20 is open position, substantially horizontally flush with the top surface of the bottom portion (not shown). The door 20 can be maintained in the closed position by means of a securing means or a locking means.

Figure 5:
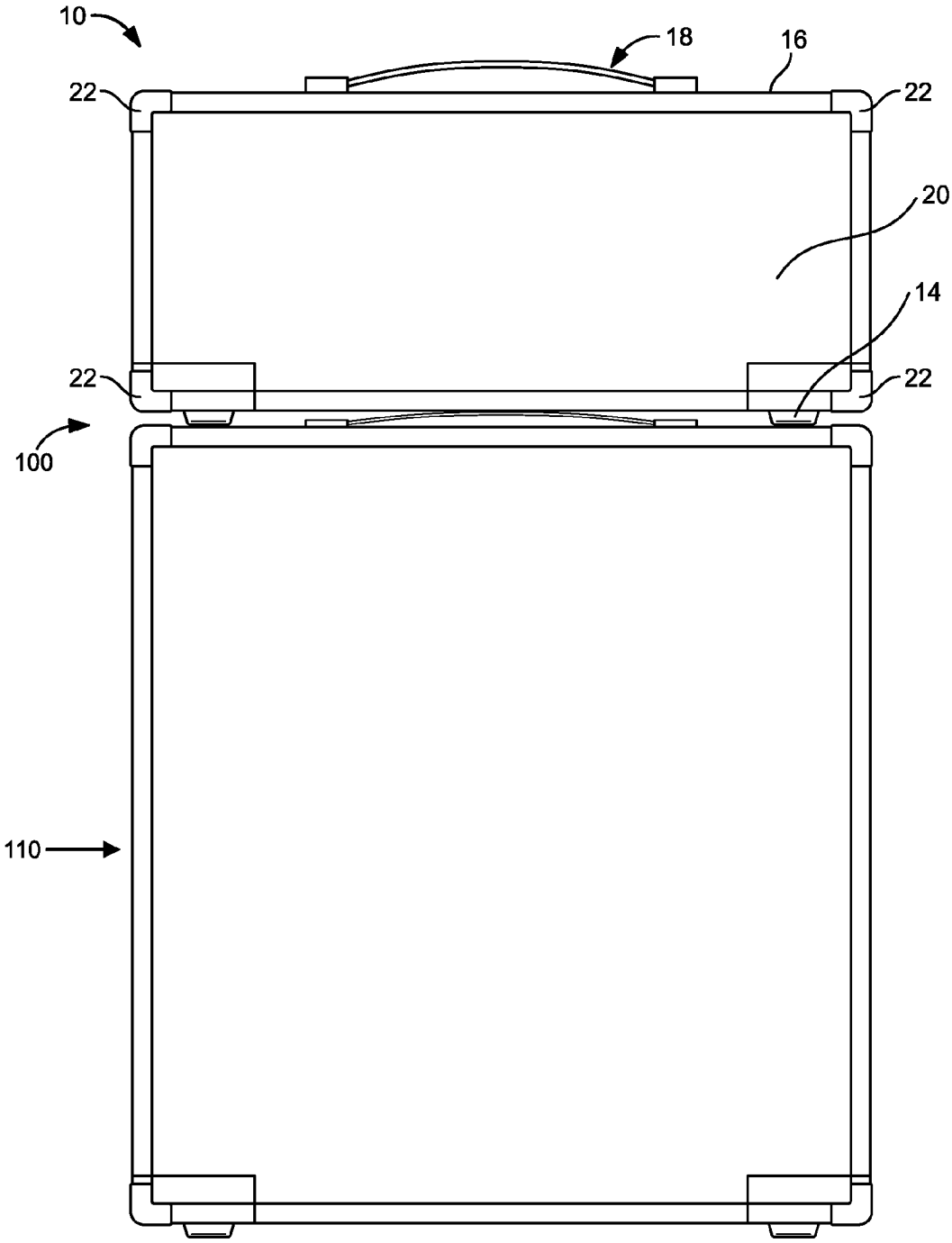
FIG. 5 is a front view of an view of an example of a kit as defined in the present document, in which the storing case of FIG. 1 is disposed on an amplifier.

As it can be seen in FIG. 5, a kit 100 comprises the storing case 10 disposed on an amplifier 110. The storing case 10 has walls comprising an external surface, which is made of a material at least visually similar to the material of external surfaces of the amplifier 110. When the storing case 10 is disposed on the amplifier 110, which is disposed on a stage, the storing case 10 seems to be, for a spectator in front of the stage, an integral part of a set comprising the storing case 10 and the amplifier 110.

The storing cases and kits have been described with regard to specific examples. The description as much as the drawings were intended to help the understanding of the document, rather than to limit its scope. It will be apparent to one skilled in the art that various modifications may be made to the storing cases and kits previously defined without departing from the scope of the document as described herein, and such modifications are intended to be covered by the present document.

The invention claimed is:

1. A kit comprising an amplifier, a head amplifier, or an amplifier stack and a storing case adapted to be disposed on top of said amplifier, amplifier head, or amplifier stack, said storing case comprising:

a bottom portion adapted to be disposed on a top surface of said amplifier, amplifier head or amplifier stack;

walls connected to said bottom portion and defining an internal chamber adapted to receive accessories normally used by a musician;

a top portion connected to at least one of said walls, said top portion being adapted to receive another amplifier, amplifier head, or amplifier stack; and at least one of said walls is pivotably connected to said bottom portion or to at least another of said walls so as to move between a closed position and an open position at which said musician has access to said chamber, or said top portion is pivotably connected to at least one of said walls and is adapted to move between a closed position and an open position at which said musician has access to said chamber, said walls comprising an external surface which is made of a material at least visually similar to the material of external surfaces of said amplifier, amplifier head, or amplifier stack, whereby when said storing case is disposed on said amplifier, amplifier head, or amplifier stack, which is disposed on a stage, said storing case seems to be, for a spectator in front of said stage, an integral part of a set comprising said storing case and said amplifier, amplifier head, or amplifier stack.

2. The kit of claim 1, wherein said at least one wall is pivotably connected to said bottom portion or to at least another of said walls and comprises an internal surface adapted to receive and secure items or said accessories thereon when said wall is in said open position.

3. The kit of claim 2, wherein said at least one wall is pivotably connected to said bottom portion or to at least another of said walls in such a manner that when said at least one wall is in said open position, said internal surface is substantially horizontally flush with a top surface of said bottom portion.

4. The kit of claim 1, wherein said walls define a top aperture which is in communication with said chamber.

5. The kit of claim 1, wherein said storing case comprises said top portion which is pivotably connected to at least one of said walls and is adapted to move between a closed position and an open position.

6. The kit of claim 1, wherein at least one shelf and/or at least one drawer is connected to at least one of said walls inside said chamber.

7. The kit of claim 1, wherein a bottom surface of said bottom portion is provided with a non-slid material.

8. The kit of claim 7, wherein said non-slid material is a non-slid spacer.

9. The kit of claim 1, wherein a top surface of said top portion is provided with a non-slid material.

10. The kit of claim 1, wherein a top surface of said top portion is provided with a handle.

11. The kit of claim 1, wherein said accessories are chosen from effect pedals, power cords, strings, pics, slides, music sheets, cd's, cleaners, and mixtures thereof.

* * * * *